US005410322A

United States Patent [19]

Sonoda

[11] Patent Number: 5,410,322

[45] Date of Patent: Apr. 25, 1995

[54] CIRCULARLY POLARIZED WAVE MICROSTRIP ANTENNA AND FREQUENCY ADJUSTING METHOD THEREFOR

[75] Inventor: Yoshiyuki Sonoda, Nagaokakyo, Japan

[73] Assignee: Murata Manufacturing Co., Ltd., Kyoto, Japan

[21] Appl. No.: 922,692

[22] Filed: Jul. 30, 1992

[30] Foreign Application Priority Data

Jul. 30, 1991 [JP] Japan ..... 3-190166
Jul. 30, 1991 [JP] Japan ..... 3-190167

[51] Int. Cl.[6] ..... H01Q 1/38
[52] U.S. Cl. ..... 343/700 MS; 343/828
[58] Field of Search ..... 343/700 MS, 828; H01Q 1/38

[56] References Cited

U.S. PATENT DOCUMENTS 4,316,194 2/1982 DeSantis et al. ..... 343/700 MS

FOREIGN PATENT DOCUMENTS 2512611 9/1982 France .
141006 8/1983 Japan ..... 343/700 MS

OTHER PUBLICATIONS

Haneishi et al., "A Design of Back-Feed . . . " Electronics and Communications in Japan, vol. 64, No. 7, Jul. 1981, pp. 52-60.
Patent Abstracts of Japan, vol. 15, No. 250 (E(1082) 25 Jun. 1989 & JP A 30 080 603.

*Primary Examiner*—Michael C. Wimer
*Attorney, Agent, or Firm*—Ortrolenk, Faber, Gerb & Soffen

[57] ABSTRACT

In a circularly polarized wave microstrip antenna 1, a ground conductor 3 and a radiation conductor 2 are provided respectively on one surface and the other surface of a dielectric substrate 4 for feeding electric power to a feeding point P eccentrically provided on the radiation conductor 2. The radiation conductor 2 is provided with at least one projection 21*a* through 21*d* for adjusting the axial ratio at a position of an angle of $45\times(2N+1)^\circ$ (N: Integer) with respect to a reference line passing through a center point O and the feeding point P on the periphery thereof, and is provided with at least one frequency adjusting projection 22*a* through 22*d* at a position of an angle of 90 N° (N: Integer) with respect to the reference line.

15 Claims, 7 Drawing Sheets

CIRCULARLY POLARIZED WAVE MICROSTRIP ANTENNA AND FREQUENCY ADJUSTING METHOD THEREFOR

BACKGROUND OF THE INVENTION

1. Field of the Invention

The present invention relates to a circularly polarized wave microstrip antenna having a dielectric substrate with a ground conductor on one surface and a radiation conductor on the other surface, and to a frequency adjustment method therefor.

2. Description of the Prior Art

Conventionally, a circularly polarized wave microstrip antenna is known in which a projection or a notch for generating a circularly polarized wave is formed at a specified position on the periphery of a radiation conductor for feeding electric power to a power feeding point eccentrically located on the radiation conductor, as disclosed in the Japanese Patent Laid-open Publication (unexamined) 3-80603.

FIG. 12 shows such a conventional circularly polarized wave microstrip antenna.

In the conventional circularly polarized wave microstrip antenna 7 shown in FIG. 12, a ground conductor (not shown) is provided on the entire part of one surface of a circular dielectric substrate 4, and a radiation conductor 8 is provided at a center position on the other surface of the substrate 4. With the above construction, an electric power is fed from the ground conductor to a feeding point P located on the radiation conductor 8 by way of a coaxial cable (not shown), wherein the feeding point P is provided radially eccentrically to the center point O.

The radiation conductor 8 is circular in form and is provided with rectangular projections 8*a* through 8*d* for radiating a circularly polarized wave at four peripheral portions where the radiation conductor 8 intersects two straight lines m and n, which are at an angle of ±45° with respect to a straight line M passing through the center point O and the feeding point P.

It is conventionally known that, when the above-mentioned projections 8*a* through 8*d* are reduced in length, the axial ratio between the major axis and the minor axis of the circularly polarized wave microstrip antenna varies and the resonance frequency at which the axial ratio is minimum is made higher. By taking advantage of the above-mentioned characteristics, adjustment of the axial ratio and the resonance frequency of the circularly polarized wave microstrip antenna 7 can be effected.

In more detail, the resonance frequency of the circularly polarized wave microstrip antenna 7 is generally determined by the diameter R of the radiation conductor 8, the dielectric constant $\epsilon$ of the dielectric substrate 4, and the thickness t of the dielectric substrate 4. Therefore, by setting the above-mentioned three parameters so that the initial frequency (unadjusted resonance frequency) of the circularly polarized wave microstrip antenna 7 is made slightly lower than a desired frequency, and by abrading the aforesaid four projections 8*a* through 8*d* by the same amount so as to reduce the length Lt of each projection, the axial ratio is adjusted to a minimum and the resonance frequency at which the axial ratio is minimum is made gradually higher so as to achieve the intended resonance frequency.

Although the above-mentioned conventional circularly polarized wave microstrip antenna 7 may be used for adjusting the resonance frequency to the desired frequency by gradually raising the resonance frequency through abrading the projections 8*a* through 8*d* for generating a circularly polarized wave, since there is no adjustment member for lowering the resonance frequency, it is very difficult to adjust the resonance frequency by gradually lowering the resonance frequency. Therefore, when the projections 8*a* through 8*d* are excessively abraded thereby making the resonance frequency exceed the desired frequency, the frequency of the antenna cannot be further adjusted thereby reducing the yield in the manufacturing process.

Furthermore, since the axial ratio and the resonance frequency of the circularly polarized wave microstrip antenna are adjusted at the same time by abrading the aforesaid projections 8*a* through 8*d*, it is difficult to achieve a balanced adjustment between both these factors.

FIG. 13 shows another conventional circularly polarized wave microstrip antenna, which is similar to that of FIG. 12, and, therefore, similar parts of FIG. 13 are designated by the same reference numerals as those of FIG. 12.

In FIG. 13, a rectangular dielectric substrate 9 is used instead of using a circular one. The radiation conductor 8 is circular in form having a radius R and is provided with rectangular projections 81*a* and 81*b* on the periphery of the radiation conductor on a line M2 inclined at an angle of 45° with respect to a straight inclined at an angle of 45° with respect to a straight line M1 passing through the center point O and the power feeding point P, and notches 82*a* and 82*b* formed on the periphery of the radiation conductor 8 on a line M3 inclined at an angle of −45° with respect to the straight line M1.

The projections 81*a* and 81*b* as well as the notches 82*a* and 82*b* serve as mode degeneration separation elements for generating a circularly polarized wave, and by changing the length of each of the projections 81*a* and 81*b* and the depth of the notches 82*a* and 82*b*, the axial ratio between the major axis and the minor axis of the circularly polarized wave microstrip antenna is varied, also varying the resonance frequency at which the axial ratio is minimum.

In more detail, when the length L1 of each of the projections 81*a* and 81*b* is reduced, the resonance frequency is made higher, or when the depth L2 of each of the notches 82*a* and 82*b* is increased, the resonance frequency is made lower.

In view of the above fact, there has been conventionally proposed a method of adjusting the resonance frequency of the circularly polarized wave microstrip antenna by adjusting the length L1 of the projections 81*a* and 81*b* and the depth L2 of the notches 82*a* and 82*b* through abrading the projections 81*a* and 81*b* and the notches 82*a* and 82*b*.

In the above-mentioned conventional circularly polarized wave microstrip antenna 7, both the axial ratio and the resonance frequency of the circularly polarized wave are adjusted at the same time by abrading the projections 81*a* and 81*b* and the notches 82*a* and 82*b* for generating a circularly polarized wave, and, therefore, it is difficult to adjust both the above-mentioned factors keeping a balance between the two.

When the length L1 of each of the projections 81*a* and 81*b* and the length L2 of each of the notches 82*a* and 82*b* are changed, an influence is exerted, for example, on such characteristics as the input impedance and the directivity of the antenna, and, therefore, it is difficult to adjust only the frequency.

SUMMARY OF THE INVENTION

The present invention was made in view of the problems mentioned above, and accordingly it is an essential object of the present invention to provide a circularly polarized wave microstrip antenna in which the frequency of the antenna can be adjusted without exerting any influence on the other characteristics, such as the axial ratio, and to provide a frequency adjustment method therefor.

In order to provide a solution to the above-mentioned problems, according to a feature of the present invention, a circularly polarized wave microstrip antenna comprises a dielectric substrate which is provided with a ground conductor on one surface thereof and a radiation conductor on the other surface thereof, and the radiation conductor is further provided with an electric power feeding point located eccentrically on the radiation conductor, and is further provided with at least one projection or notch each for adjusting the axial ratio of the antenna at a position of an angle of $45\times(2N+1)°$ (N: Integer) with respect to a reference line passing through the center point of the radiation conductor and the power feeding point on the periphery of the radiation conductor, and at least one frequency adjusting projection or notch at a position of an angle of 90N° (N: Integer) with respect to the above-mentioned reference line on the periphery of the radiation conductor.

It is noted that a second power feeding point may also be provided on the radiation conductor at a position located on the line at an angle of 90° and 270° with respect to the reference line.

It is noted that each frequency adjusting projection or notch at a position of an angle of 90N° may consist of a plurality of projection members, and conductor-blank portions formed in proximity to the root portions of the frequency adjusting projections for forming a slit-like notch.

According to the present invention, at least one projection or notch is formed at each of the above-mentioned specified positions on the periphery of the radiation conductor for adjusting the resonance frequency, and when the length of each projection or notch is changed, the resonance frequency can be varied without exerting any influence on the other characteristics, such as the directivity and the input impedance.

In other words, when the length of each projection is reduced, the resonance frequency is made higher, or when the length of each projection is increased, the resonance frequency is made lower.

Therefore, in the circularly polarized wave microstrip antenna of the present invention, it is possible to gradually raise the resonance frequency in adjustment by abrading each of the projections provided on portions of the periphery of the radiation conductor by the same amount so as to reduce the length of each projection without exerting any influence on the other characteristics.

Moreover, in the case where the notches are formed in place of the projections for varying the resonance frequency, when the notch length is reduced, the resonance frequency is made higher, and when the notch length is increased, the resonance frequency is made lower.

Therefore, in the circularly polarized wave microstrip antenna of the present invention, it is possible to adjust the resonance frequency without exerting any influence on the other characteristics by abrading each of the notches formed on the periphery of the radiation conductor by the same amount so as to adjust the notch length.

Therefore, the circularly polarized wave microstrip antenna is capable of gradually making higher or lower the resonance frequency in adjustment by abrading each projection or notch provided on the periphery of the radiation conductor by the same amount to thereby reduce the length of each projection or increase the length of each notch without exerting any influence on the other characteristics.

On the other hand, in the case where the conductor-blank portion is provided for reducing the resonance frequency in adjustment, by abrading the radiation conductor circumferentially with the conductor-blank portion serving as a guide so as to form the same number of slits on the periphery of the four radiation conductor portions, the resonance frequency of the circularly polarized wave microstrip antenna can be reduced.

Therefore, in the circularly polarized wave microstrip antenna of the present invention, the resonance frequency of the circularly polarized wave microstrip antenna is gradually raised so as to achieve adjustment by abrading each of the projections provided on the four peripheral portions of the radiation conductor by the same amount so as to reduce the length of each projection, while the resonance frequency of the circularly polarized wave microstrip antenna is gradually made lower so as to achieve adjustment by abrading the radiation conductor circumferentially so as to form slit-like notches on the periphery of the four radiation conductor portions.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

Figure 1:
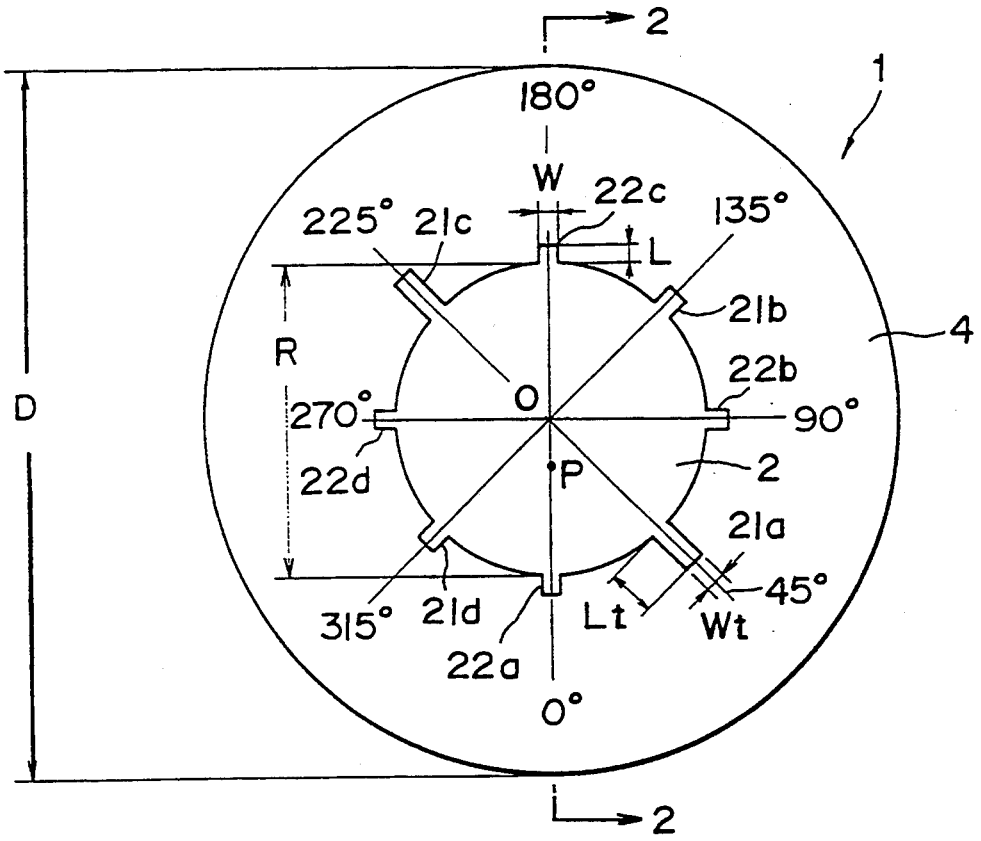
FIG. 1 is a plan view of a circularly polarized wave microstrip antenna in accordance with a first embodiment of the present invention.

Before the description proceeds, it is noted that, since the basic structure of the preferred embodiments of a circularly polarized wave microstrip antenna is similar to those of the conventional ones, like parts are designated by the same reference numerals throughout the drawings.

Figure 2:
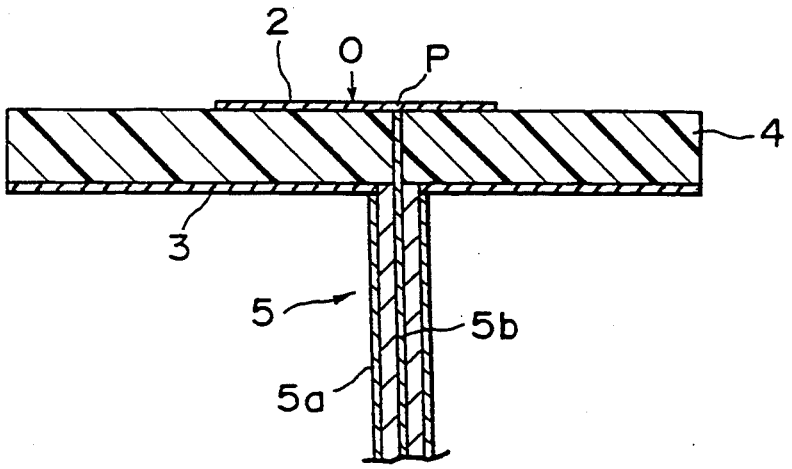
FIG. 2 is a sectional view of the antenna taken along the line 2—2 in FIG. 1.

FIGS. 1 and 2 show a circularly polarized wave microstrip antenna in accordance with a first embodiment of the present invention.

In a circularly polarized wave microstrip antenna 1 shown in FIGS. 1 and 2, a circular dielectric substrate 4 is provided with a ground conductor 3 on its entire lower surface and a circular radiation conductor 2, having a diameter R sufficiently shorter than the diameter D of the dielectric substrate 4, centrally on its upper surface. Electric power feeding is effected by way of a coaxial cable 5 from the ground conductor 3 to a power feeding point P of the radiation conductor 2. The power feeding point P is located radially eccentrically to the center point O. The coaxial cable 5 has its outer conductor 5*a* connected to the ground conductor 3 and its inner conductor 5*b* connected to the radiation conductor 2 passing through the dielectric substrate 4.

Rectangular projections 21*a* through 21*d* each having a width Wt and a length Lt are formed on the periphery of the radiation conductor 2 in a direction at an angle of $45\times(2N+1)^\circ$ (N: Integer) with respect to a radial direction passing through the center point O of the radiation conductor 2 and the power feeding point P, i.e., in the directions at angles of 45°, 135°, 225°, and 315°. It is noted that each of the projections 21*a* and 21*c* in the direction of 45° and 225° has a length Lt longer than the length of each of the projections 21*b* and 21*d* in the direction of 135° and 315°.

The projections 21*a* through 21*d* are mode degeneration separation elements for radiating a circularly polarized wave. So long as at least one of the four peripheral portions of the radiation conductor 2 is provided with a projection, a circularly polarized wave can be generated.

By varying the length Lt of the projections 21*a* through 21*d*, it is possible to vary the axial ratio (which is the ratio of the major axis to the minor axis of the circularly polarized wave) as well as to vary the resonance frequency at which the axial ratio is minimum. When the length Lt of each of the projections 21*a* through 21*d* is reduced, the resonance frequency at which the axial ratio is minimum is made higher. When the projection length Lt is increased, the resonance frequency is made lower.

Therefore, by adjusting the length Lt of each of the projections 21*a* through 21*d* in a manner as described hereinafter, the ratio of the major axis to the minor axis of the circularly polarized wave microstrip antenna can be adjusted.

It is noted that the projections 21*a* through 21*d* may be replaced with notches, and the axial ratio may be adjusted by adjusting the length of each of the notches in order to radiate a circularly polarized radio wave. In the case where notches are provided, contrary to the case of providing projections, the resonance frequency at which the axial ratio is minimum is made lower when the notch length is reduced, or the resonance frequency is made higher when the notch length is increased.

Rectangular projections 22*a* through 22*d* each having a width W and a length L are provided in a direction at an angle of 90N° (N:Integer), i.e., in the directions at angles of 0°, 90°, 180°, and 270° on the periphery of the radiation conductor 2.

The projections 22*a* through 22*d* serve as frequency adjusting sections for adjusting the resonance frequency of the circularly polarized wave microstrip antenna 1. When the length L of each of the projections a through 22*d* is increased, the resonance frequency can be made lower, or when the projection length L is reduced, the resonance frequency can be made higher.

Therefore, by abrading the projections 22*a* through 22*d* provided at the four peripheral portions of the radiation conductor 2 by the same amount, as described hereinafter, so as to reduce the projection length L, the resonance frequency can be gradually made higher in adjustment without exerting any influence on such characteristics as the directivity, the input impedance, and the axial ratio of the circularly polarized wave of the circularly polarized wave microstrip antenna 1.

Figure 3:
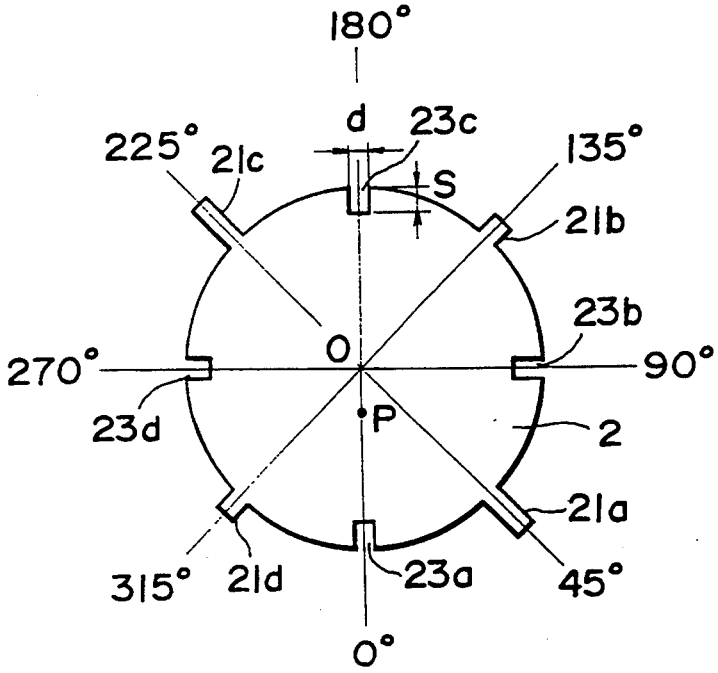
FIG. 3 is a plan view of the form of a radiation conductor of a circularly polarized wave microstrip antenna in accordance with a second embodiment of the present invention.

It is noted in the present embodiment that, although the projections 22*a* through 22*d* for frequency adjustment are provided at the four peripheral portions of the radiation conductor 2, the projections 22*a* through 22*d* may be replaced with notches 23*a* through 23*d* each having a width d and a length (depth) S, as shown in FIG. 3 of a second embodiment.

Figure 7:
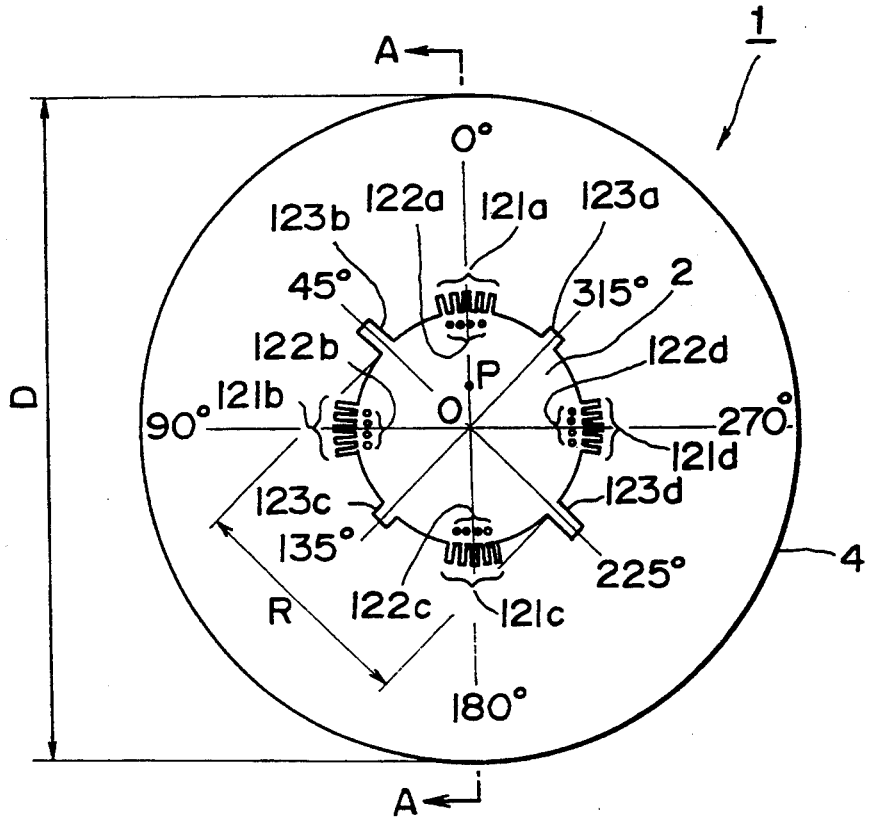
FIG. 7 is a plan view of a circularly polarized wave microstrip antenna in accordance with a fifth embodiment of the present invention.

Also, it is noted that each of the projections 22*a* through 22*d* may be replaced with slit-shaped projection groups as shown in FIG. 7 of a fifth embodiment.

Referring to FIG. 3, in the case where the notches 23*a* through 23*d* are formed, the resonance frequency can be made lower when the length (depth) S of each of the notches 23*a* through 23*d* is increased, or made higher when the notch length S is reduced.

Therefore, by abrading the notches 23*a* through 23*d* formed at the four peripheral portions of the radiation conductor 2 by the same amount so as to increase the notch depth S, the resonance frequency can be gradually made lower in adjustment without exerting any influence on the other characteristics of the circularly polarized wave microstrip antenna 1.

Figure 4:
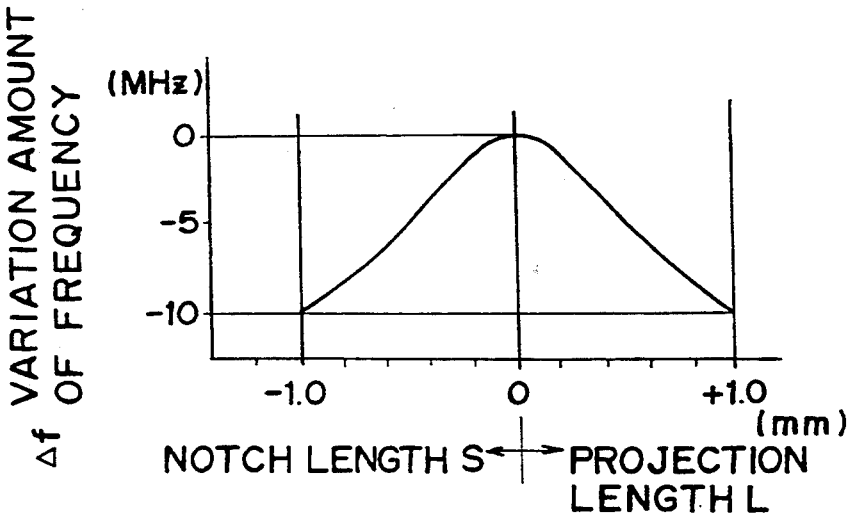
FIG. 4 is a graph of the variation amount of the resonance frequency with respect to the length of each of the projections or notches.

FIG. 4 shows an experimental example of the variation amount of the resonance frequency with respect to the length L of each of the projections 22*a* through 22*d* and to the length S of each of the notches 23*a* through 23*d*.

Referring to FIG. 4, a circularly polarized wave microstrip antenna 1 having a resonance frequency of about 1.575 GHz was subjected to an experiment, where the variation of the resonance frequency was examined by changing the length of the projections 22*a* through 22*d* in the case of FIG. 1 (or changing the depth of the notches 23*a* through 23*d* in the case of FIG. 3) formed at the four peripheral portions of the radiation conductor 2 by the same amount at the same time.

In FIG. 4, the condition that each projection (or notch) has a length of O mm means the condition that none of the projections 22*a* through 22*d* (or notches 23*a* through 23*d*) are formed, where the resonance frequency is represented by a reference value of 0 (MHz). The curve in FIG. 4 indicates the variation amount of the resonance frequency obtained by changing the length L of each of the projections 22*a* through 22*d* or the length S of each of the notches 23*a* through 23*d* with regard to the above-mentioned reference condition of the resonance frequency.

The circularly polarized wave microstrip antenna 1 subjected to the experiment has a resonance frequency fo=1.575 GHz and the following dimensions:

Dielectric substrate 4 having:
Dielectric constant $\epsilon$=21.4, Diameter D=37 mm, Thickness t=6 mm
Circular radiation conductor 2 having:
a diameter R=20.6 mm
Axial ratio adjusting projections 21*a* and 21*c* having:
Width Wt=1 mm, Length Lt=2 mm
Axial ratio adjusting projections 21*b* and 21*d* having:
Width Wt=1 mm, Length Lt=1 mm
Projections 22*a* through 22*d* having:
Width W=0.7 mm, Length L=0 to 1 mm
Notches 23*a* through 23*d* having:
Width d=0.7 mm, Length S=0 to 1 mm.

As obvious from FIG. 4, the resonance frequency varies in proportion to the length L of each of the projections 22*a* through 22*d* or in proportion to the length (depth) S of each of the notches 23*a* through 23*d*, and the rate of variation of the resonance frequency is about +10 MHz/mm when the length L of each of the projections 22*a* through 22*d* is reduced, or about −10 MHz/mm when the length S of each of the notches 23*a* through 23*d* is increased.

Therefore, by gradually abrading the projections 22*a* through 22*d* so as to reduce the length L of each of the projections 22*a* through 22*d* or by gradually abrading the notches 23*a* through 23*d* so as to increase the depth S of each of the notches 23*a* through 23*d*, the resonance frequency can be made higher or lower in a unit of several megahertz to enable achieving a fine tuning of the frequency.

The following describes frequency adjustment procedures of the circularly polarized wave microstrip antenna 1 provided with the radiation conductor 2 having the projections 22*a* through 22*d* mentioned above.

The resonance frequency of the circularly polarized wave microstrip antenna 1 is determined principally by the parameters of the thickness t of the dielectric substrate 4, the dielectric constant $\epsilon$ of the dielectric substrate 4, and the diameter R of the radiation conductor 2. Therefore, the above-mentioned three parameters are designed to have appropriate values, and the initial value of the resonance frequency (unadjusted resonance frequency at which the dielectric substrate 4 provided with the radiation conductor 2 and the ground conductor 3, respectively, on its upper and lower surfaces and the antenna has a minimum axial ratio) of the circularly polarized wave microstrip antenna 1 is made slightly lower than the desired value. For example, in the case shown in FIG. 4, the initial frequency is set at about 1.57 GHz.

When the axial ratio of the circularly polarized wave microstrip antenna is out of the standard range, the axial ratio adjusting projections 21*a* through 21*d* are abraded by the same amount once or several times so as to adjust the axial ratio of the circularly polarized wave microstrip antenna within the standard range. Then, by abrading the frequency adjusting projections 22*a* through 22*d* by the same amount once or several times, the resonance frequency fo is gradually made higher so as to be adjusted to the desired frequency. For example, in the case shown in FIG. 4, the resonance frequency is adjusted to the intended frequency of 1.575 GHz.

It is noted that, in the second embodiment, when the radiation conductor 2 is provided with the notches 23*a* through 23*d*, as shown in FIG. 3, instead of providing the projections 22*a* through 22*d* shown in FIG. 1, by making the initial frequency slightly higher than the desired frequency, in contrast to the case of the first embodiment, and by abrading the notches 23*a* through 23*d* so as to increase the depth S thereof by the same amount once or several times, the resonance frequency fo is gradually made lower so as to be adjusted to the desired frequency.

Although, in the above-mentioned first and second embodiments, the radiation conductor 2 is provided with a single power feeding point P thereon in the circularly polarized wave microstrip antenna 1, the same effect can be obtained by providing two power feeding points P1 and P2 on the radiation conductor 2 of a circularly polarized wave microstrip antenna 1.

Figure 5:
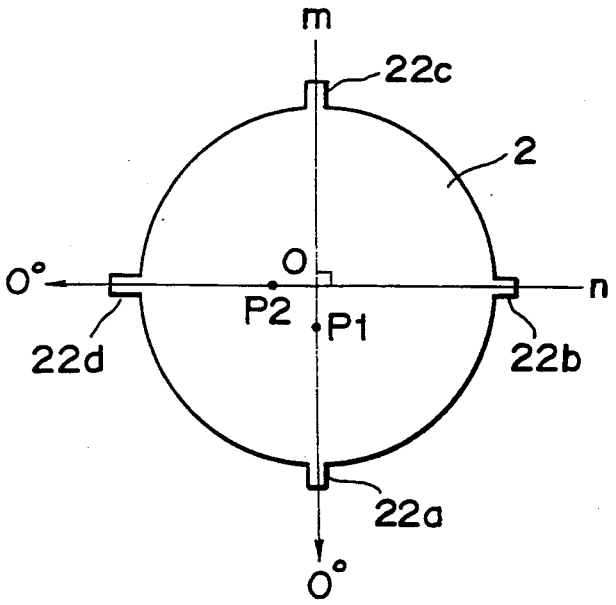
FIG. 5 is a plan view of the form of a radiation conductor of a circularly polarized wave microstrip antenna in accordance with a third embodiment of the present invention.

FIG. 5 shows a third embodiment of a radiation conductor 2 which is provided with two power feeding points P1 and P2 in the circularly polarized wave microstrip antenna 1, and which is provided with the frequency adjusting projections 22*a* through 22*d*.

The first and second power feeding points P1 and P2 are eccentrically provided at appropriate portions of the radiation conductor 2 as located respectively on straight lines m and n which intersect each other at the center point O of the radiation conductor 2 having a circular form. The frequency adjusting projections 22*a* and 22*c* are provided at positions in the direction of angles of 0° and 180° with respect to a direction passing through the center point O and the first feeding point P1, while the projections 22*b* and 22*d* are provided at positions of angles of 0° and 180° with respect to the direction passing through the center point O and the second feeding point P2.

Figure 6:
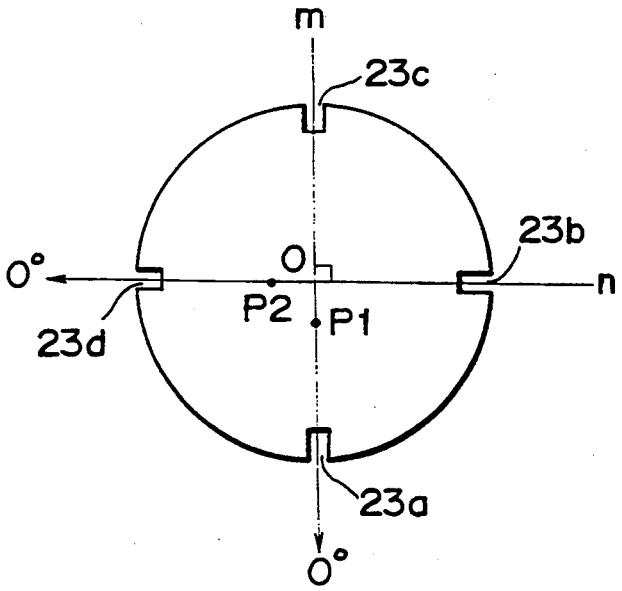
FIG. 6 is a plan view of the form of a radiation conductor of a circularly polarized wave microstrip antenna in accordance with a fourth embodiment of the present invention.

FIG. 6 shows a fourth embodiment of a radiation conductor 2 of such a double-point feeding type circularly polarized wave microstrip antenna having the frequency adjusting notches 23*a* through 23*d* formed instead of providing the projections 22*a* through 22*d* on the radiation conductor 2 shown in FIG. 5.

It is noted that, although each of the projections 22*a* through 22*d* or each of the notches 23*a* through 23*d* has one constituent member at the aforesaid specific positions on the periphery of the radiation conductor 2 in the third and fourth embodiments shown in FIGS. 5 and 6, respectively, each of the projections 22*a* through 22*d* or the notches 23*a* through 23*d* may have two or more constituent members.

The frequency adjusting projections 22*a* through 22*d* or notches 23*a* through 23*d* may be formed at the specific peripheral portions of a radiation conductor 2 having a rectangular or another arbitrary form other than the circular form.

As described above, according to the first embodiment of the present invention, in a one-point feeding type circularly polarized wave microstrip antenna, where a ground conductor and a radiation conductor are provided respectively on a lower surface and an upper surface of a dielectric substrate, since at least one projection for frequency adjustment is formed in the direction at an angle of 90N° (N: Integer) with respect to the line passing through the center of the radiation conductor and the feeding point, by abrading the projection to reduce the projection length, the resonance frequency can be made higher in adjustment without exerting any influence on the other characteristics.

According to the second embodiment of the present invention, since notches are formed instead of the projections for frequency adjustment, by abrading the notches to increase the notch length, the resonance frequency can be made lower in adjustment without exerting any influence on the other characteristics.

According to the third and fourth embodiments of the present invention, there is provided a double-point feeding type circularly polarized wave microstrip antenna in which a ground conductor and a radiation conductor are disposed respectively on a lower surface and an upper surface of a dielectric substrate, and since at least one frequency adjusting projection or notches is provided at positions of angles of 0° and 180° with respect to the direction passing through the center point and the first feeding point P1 and at positions of angles of 0° and 180° with respect to the direction passing through the center point and the second feeding point P2, the resonance frequency can be made higher or lower in adjustment without exerting any influence on the other characteristics in the same manner as described above.

Figure 8:
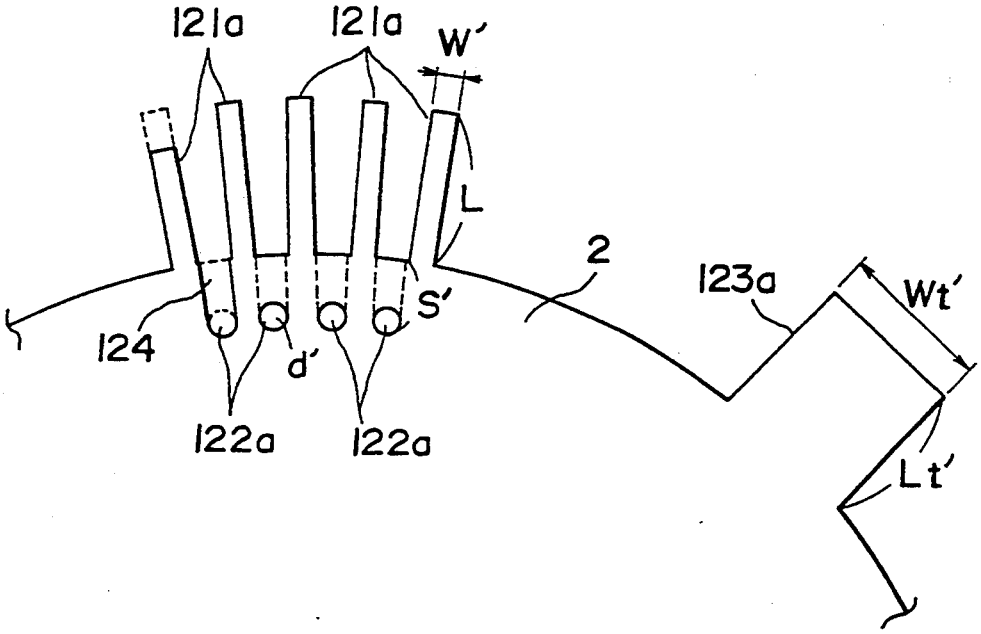
FIG. 8 is an enlarged view of a projection, a conductor-blank portion, both for frequency adjustment, and a projection for adjusting the axial ratio formed on the periphery of the radiation conductor in FIG. 7.

FIGS. 7 and 8 show a fifth embodiment of a circularly polarized wave microstrip antenna in accordance with the present invention, which is similar to the first embodiment except that projection groups 121*a* through 121*d* are provided, each consisting of, for example, five projection members for frequency adjustment, instead of providing the projections 22*a* through 22*d* in FIG. 1, in a direction at an angle of 90N° (N: Integer), i.e., in the directions at angles of 0°, 90°, 180°, and 270° on the periphery of the radiation conductor 2. Moreover, in this fifth embodiment, in proximity to root portions of the projection groups 121*a* through 121*d* in the periphery of the radiation conductor 2, there are formed conductor-blank portions 122*a* through 122*d* each consisting of, for example, four holes for frequency adjustment.

It is noted that each of the projection groups 121*a* through 121*d* may have at least one member maybe provided in each projection group although five members are provided in the drawings, while each of the conductor-blank portions 122*a* through 122*d* may also have at least one hole provided in each conductor blank portion 122*a* through 122*d* although 4 members are shown in the drawings.

FIG. 8 shows an enlarged view of the projection group 121*a* and conductor-blank portion 122*a*, both for frequency adjustment, formed in the direction at an angle of 0°, and the projection 123*a* for axial ratio adjustment formed in the direction at an angle of 315° on the periphery of the radiation conductor 2.

Each of the five members of the projection group 121*a* has an appropriate width W' and length L' while radially projecting from the periphery of the radiation conductor 2 with appropriate intervals therebetween. Each of the four holes of the conductor-blank portion 122*a* is a circular hole having an appropriate diameter d' formed in the vicinity spaced apart from the edge of the periphery of the radiation conductor 2 by a prescribed distance S' on a line passing through the interval portions of the projection 121*a* and the center point O.

The four circular holes of the conductor-blank portion 122*a* may be formed in the dielectric substrate 4 before the radiation conductor 2 is formed on the dielectric substrate 4, or after the radiation conductor 2 is formed on the dielectric substrate 4.

It is noted that the conductor-blank portions 122*a* through 122*d* are made so as to serve as guides for forming a notched portion 124, and, therefore, they may have an arbitrary form such as circle, ellipse, or rectangle.

The projection groups 121*a* through 121*d* are formed for raising the resonance frequency in adjustment. Practically, by abrading the projection groups 121*a* through 121*d* (refer to the dotted portion of the projection group 121*a* in FIG. 8) so as to reduce the length L', the resonance frequency fo of the circularly polarized wave microstrip antenna 1 is made higher according to the reduction of the length L'. Particularly, when the projection groups 121*a* through 121*d* provided at the four peripheral portions of the radiation conductor 2 are abraded by the same amount, the resonance frequency fo can be made gradually higher without exerting any influence on the characteristics such as input impedance and axial ratio of the circularly polarized wave microstrip antenna 1.

The conductor-blank portions 122*a* through 122*d* are formed for lowering the resonance frequency. Practically, by radially abrading the radiation conductor 2 with the conductor-blank portion 122*a* serving as a guide, as shown in FIG. 8, so as to form a slit-like notched portion 124 on the periphery of the radiation conductor 2, the resonance frequency fo can be made lower according to the increment of the number of the notches 124. Particularly, by forming the same amount of the notches 124 at the four peripheral portions 122*a* through 122*d* of the radiation conductor 2, the resonance frequency can be lowered without exerting any influence on the characteristics such as input impedance and axial ratio of the circularly polarized wave microstrip antenna 1.

Figure 9:
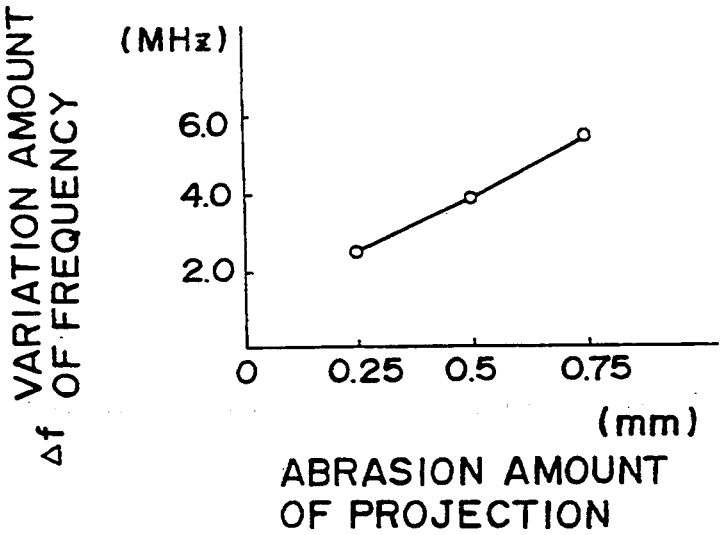
FIG. 9 is a graph of the variation amount of the frequency with respect to an abrading amount of a projection for frequency adjustment of FIG. 8.

FIG. 9 shows a variation amount (increase amount) of the resonance frequency with respect to an abrading amount of the projection member 121*a* obtained through an experiment.

Figure 10:
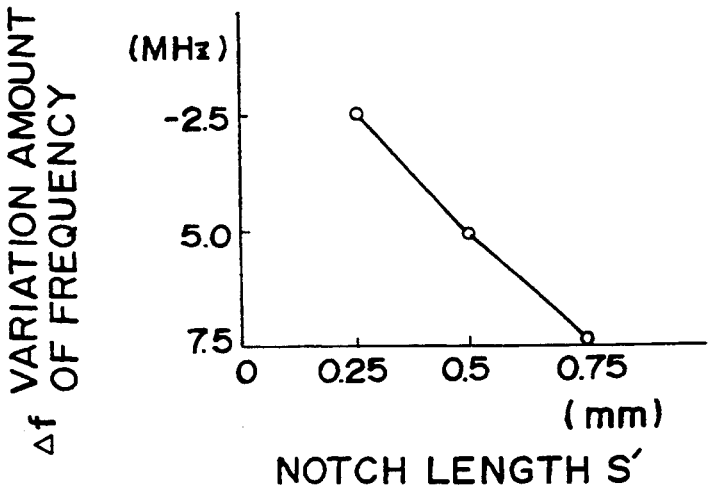
FIG. 10 is a graph of the variation amount of the frequency with respect to the notch length of FIG. 8.

FIG. 10 shows a variation amount (decrease amount) of the resonance frequency with respect to the length (depth) S' of the notch 124 obtained through an experiment.

It is noted that the abrading amount of the projection shown in FIG. 9 indicates the abrading amount of each of the projection groups 121*a* through 121*d* provided at the four peripheral portions of the radiation conductor 2. In FIG. 10, the length S' indicates the length of the notch 124 in the case where one notch 124 is formed at each of the four peripheral portions of the radiation conductor 2.

The circularly polarized wave microstrip antenna 1 subjected to an experiment has a resonance frequency fo=1.575 GHz and the following dimensions:

Dielectric substrate 4 having:

Dielectric constant $\epsilon=21.4$, Diameter D=37 mm, Thickness t=6 mm

Circular radiation conductor 2 having:

a diameter R−20.6 mm:

Frequency adjusting projection groups 121*a* through 121*d* having:

Width W'=0.4 mm, Length L'=1 mm;

Conductor-blank portions 122*a* through 122*d*:

Circular hole having a diameter d'=0.7 mm,

Formable notch (124) having length S'=0.25 mm to 0.75 mm;

Axial ratio adjusting projections 123*a* and 123*c* having:

Width Wt'=1 mm, Length Lt'=1 mm;

Axial ratio adjusting projections 123*b* and 123*d* having:

Width Wt'=1 mm, Length Lt'=2 mm

As shown in FIG. 9, it was found that the resonance frequency fo is raised at steps of 0.7 MHz every time each of the projection groups 121*a* through 121*d* at the four peripheral portions of the radiation conductor 2 is reduced by 0.1 mm. Therefore, by abrading each of the projection groups 121*a* through 121*d* at the four peripheral portions of the radiation conductor 2 by an appropriate amount, the resonance frequency fo of the circularly polarized wave microstrip antenna 1 is gradually made higher thereby to effect fine adjustment of the resonance frequency.

As shown in FIG. 10, it was found that the resonance frequency fo is lowered by about 2.5 MHz when a notch 124 having a length S'=0.25 mm is formed on each of the four peripheral portions of the radiation conductor 2, and that the resonance frequency is made lower by about 1 MHz every time the length S' of the notch 124 is increased by 0.1 mm. Therefore, with the conductor-blank portions 122*a* through 122*d*, being provided so as to enable the formation of a notch 124 having an appropriate length, by increasing the amount of the notch 124 formed at the four peripheral portions of the radiation conductor 2, the resonance frequency is made lower step by step so as to enable fine tuning of the resonance frequency fo of the circularly polarized wave microstrip antenna 1.

The following describes the frequency adjustment procedure of the circularly polarized wave microstrip antenna 1 mentioned above.

The resonance frequency fo of the circularly polarized wave microstrip antenna 1 is determined principally by the parameters of thickness t of the dielectric substrate 4, the dielectric constant $\epsilon$ of the dielectric substrate 4, and the diameter R of the radiation conductor 2. Therefore, the three parameters t, $\epsilon$ and R are designed so as to have appropriate values, and the initial frequency (unadjusted resonance frequency at which the axial ratio of the circularly polarized wave microstrip antenna is minimum with the dielectric substrate 4 provided with the radiation conductor 2 and the ground conductor 3 respectively on its upper and lower surfaces) of the resonance frequency fo of the circularly polarized wave microstrip antenna 1 is made slightly lower than the desired value. For example, in the case shown in FIG. 9, the initial frequency is set at about 1.57 GHz.

When the axial ratio of the circularly polarized wave microstrip antenna is not within the standard range, the projections 123*a* through 123*d* are abraded by the same amount once or several times for adjusting the axial ratio of the circularly polarized wave within the standard range. When the resonance frequency fo obtained after the axial ratio, has been adjusted is smaller than the desired value, the projections 121*a* through 121*d* are abraded by the same amount once or several times, whereby the resonance frequency fo is gradually raised so as to be adjusted to the desired frequency. For example, in the case shown in FIG. 9, the resonance frequency is adjusted to the desired frequency of 1.575 GHz.

It is noted that, in the above-mentioned abrading procedure, the members of the projection groups 121*a* through 121*d* may be abraded off one by one in one processing time, or abraded in such a manner that a part of each member of the projections 121*a* through 121*d* is abraded in one processing time and, after completely abrading off the entire member in several processing times, the abrading process of the next member of each of the projection groups 121*a* through 121*d* is started.

When the projections 121*a* through 121*d* are excessively abraded so as to make the resonance frequency fo higher than the desired frequency, a notch 124 is formed at each of the four peripheral portions of the radiation conductor 2 with the conductor-blank portions 122*a* through 122*d* serving as guides, the work of which is repeated once or several times so that the resonance frequency fo is gradually made lower so as to be adjusted to the desired frequency.

When the resonance frequency fo after undergoing the axial ratio adjustment procedure is higher than the desired frequency, the resonance frequency fo is gradually made lower so as to be adjusted to the desired frequency by forming a notch 124 with the conductor-blank portions 122*a* through 122*d* serving as guides. When the resonance frequency fo is made lower than the desired frequency in the process, the projections 121*a* through 121*d* are further abraded, whereby the resonance frequency fo is gradually made higher so as to be adjusted to the desired frequency.

Figure 11:
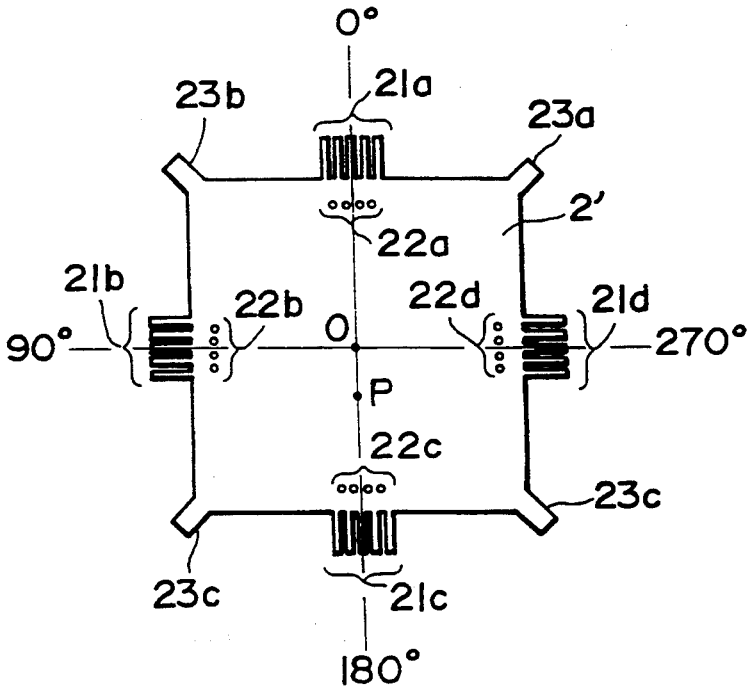
FIG. 11 is a plan view of a radiation conductor of a circularly polarized wave microstrip antenna in accordance with a sixth embodiment of the present invention.
Figure 12:
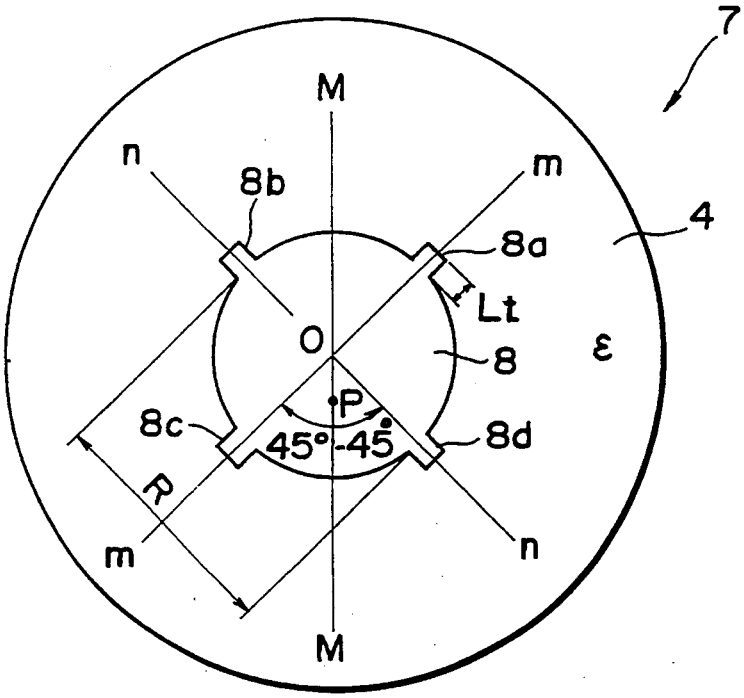
Fig. 12 (PRIOR ART)
FIG. 12 is a plan view of an exemplary conventional circularly polarized wave microstrip antenna.
Figure 13:
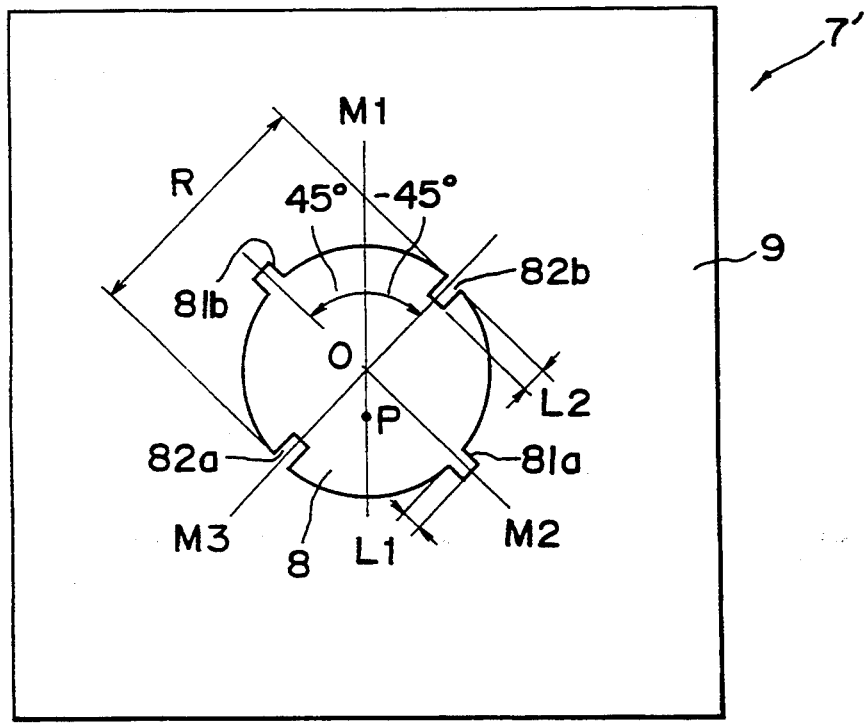
Fig. 13 (PRIOR ART)
FIG. 13 is a plan view of another exemplary conventional circularly polarized wave microstrip antenna.

It is noted that, although the above first embodiment describes a circularly polarized wave microstrip antenna 1 having a circular radiation conductor 2, the shape of the radiation conductor 2 is not limited to a circular one and the present invention may have a rectangular radiation conductor 2' as shown in FIG. 11 or may be applied to a circularly polarized wave microstrip antenna 1 having an arbitrarily-shaped radiation conductor.

As described above, according to the fifth embodiment of the present invention, in a circularly polarized wave microstrip antenna where a ground conductor and a radiation conductor are provided on a dielectric substrate, since the projections for raising the resonance frequency and the conductor-blank portions for lowering the resonance frequency in adjustment are formed in the direction at an angle of 90N° (N: Integer) with respect to the line passing through the center O of the radiation conductor and the power feeding point P, by adjusting the length of the above-mentioned projections or the length of the notches formed with the conductor-blank portions serving as guides, the resonance frequency can be adjusted without exerting any influence on the other characteristics.

Moreover, since the resonance frequency is adjusted by abrading the projections for raising the resonance frequency preformed at the specific peripheral portions of the radiation conductors of the circularly polarized wave microstrip antenna or by forming a notch for lowering the resonance frequency with the conductor blank portions serving as guides, the resonance frequency can be easily adjusted without exerting any influence on the other characteristics.

When frequency adjustment is effected excessively so as to exceed the desired frequency, the frequency can be readjusted downwardly, which prevents the possibility of obtaining an unadjustable frequency of the antenna.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circularly polarized wave microstrip antenna comprising:

a dielectric substrate provided with a ground conductor on one surface thereof and a radiation conductor on the other surface thereof, said radiation conductor having a periphery and a center point, and feeding electric power to an electric power feeding point located eccentrically on said radiation conductor, said radiation conductor being further provided with:

at least one axial ratio adjusting member for adjusting the axial ratio of the antenna, said axial ratio adjusting member being located on the periphery of said radiation conductor so that a first line passing through said axial ratio adjusting member and the center point of said radiation conductor forms an angle of $45\times(2N+1)^\circ$ with respect to a reference line passing through the center point of said radiation conductor and said electric power feeding point; and at least one frequency adjusting member for adjusting the resonance frequency of said antenna, said frequency adjusting member also being located on the periphery of said radiation conductor so that a second line passing through said frequency adjusting member and the center point of said radiation conductor forms an angle of 90N° with respect to the reference line passing through the center point and said electric power feeding point, wherein N is an integer.

2. A circularly polarized wave microstrip antenna as claimed in claim 1, wherein each frequency adjusting member on the second line forming an angle of 90° N with the reference line includes a plurality of slit-like projection members, said each frequency adjusting member having a root portion on said radiation conductor; conductor-blank portions formed in proximity to said root portion of said each frequency adjusting member thereby serving as a guide to form a corresponding slit-like notch for adjusting the frequency of said antenna.

3. A method of adjusting the resonance frequency of the circularly polarized wave microstrip antenna as claimed in claim 1 comprising the steps of:

forming said frequency adjusting member so as to have a predetermined size;

forming said axial ratio adjusting member so as to have a predetermined size; and adjusting the respective sizes of said frequency adjusting member and axial adjusting member, thereby adjusting the resonance frequency of said circularly polarized wave microstrip antenna.

4. A circularly polarized wave microstrip antenna as claimed in claim 1, wherein said frequency adjusting member is a projection formed on the periphery of said radiation conductor.

5. A circularly polarized wave microstrip antenna as claimed in claim 1, wherein said frequency adjusting member is a notch formed on the periphery of said radiation conductor.

6. A circularly polarized wave microstrip antenna as claimed in claim 1, wherein said axial ratio adjusting member is a projection formed on the periphery of said radiation conductor.

7. A circularly polarized wave microstrip antenna as claimed in claim 1, wherein said axial ratio adjusting member is a notch formed on the periphery of said radiation conductor.

8. A circularly polarized wave microstrip antenna as claimed in claim 1, wherein said frequency adjusting member is generally rectangular in shape.

9. A circularly polarized wave microstrip antenna as claimed in claim 1, wherein said axial ratio adjusting member is generally rectangular in shape.

10. A circularly polarized wave microstrip antenna as claimed in claim 1, wherein four axial ratio adjusting members are provided, respective lines passing through each of said four axial ratio adjusting members and the center point of said radiation conductor so as to form angles of 45°, 135°, 225° and 315° with the reference line; each of said four axial ratio adjusting members having a corresponding length so that the respective lengths of said axial ratio adjusting members located at 45° and 225° is longer than the respective lengths of said axial ratio adjusting members located at 135° and 315°.

11. A circularly polarized wave microstrip antenna as claimed in claim 1, wherein said axial ratio adjusting member is a mode degeneration separation element for radiating a circularly polarized wave.

12. A circularly polarized wave microstrip antenna as claimed in claim 1, wherein said radiation conductor has a shape selected from the group consisting of circular and rectangular.

13. A circularly polarized wave microstrip antenna as claimed in claim 2, wherein said each frequency adjusting member includes five slit-like projection members.

14. A circularly polarized wave microstrip antenna as claimed in claim 2, wherein said conductor-blank portions include holes formed therein; said holes being formed spaced away by a predetermined distance from the edge of the periphery of said radiation conductor.

15. A method of adjusting the resonance frequency as claimed in claim 3, wherein the step of adjusting comprises abrading said frequency adjusting member and axial adjusting member.

* * * * *